US005963242A

United States Patent [19]

Nakayama et al.

[11] Patent Number: 5,963,242

[45] **Date of Patent: *Oct. 5, 1999**

[54] IMAGE RECORDING APPARATUS WITH AN ARRAY LIGHT SOURCE

[75] Inventors: Hideo Nakayama; Hiromi Otoma; Nobuaki Ueki; Yasuji Seko; Akemi Murakami; Mario Fuse, all of Ebina; Masao Ito, Ashigarakami-gun; Izumi Iwasa, Ebina, all of Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,220

[22] Filed: Oct. 29, 1996

[30] Foreign Application Priority Data

Jan. 22, 1996 [JP] Japan ..... 8-008719

[51] Int. Cl.[6] ..... B14J 2/45; B14J 2/47; B14J 2/435

[52] U.S. Cl. ..... 347/238; 347/241; 347/237

[58] Field of Search ..... 347/238, 241, 347/248, 250, 232, 247, 237; 356/237; 359/455

[56] References Cited

U.S. PATENT DOCUMENTS

| | | | |
|---|---|---|---|
| 4,755,030 | 7/1988 | Araki et al. | 359/662 |
| 4,863,251 | 9/1989 | Herloski et al. | 359/778 |
| 5,483,511 | 1/1996 | Jewell et al. | 369/44.37 |

FOREIGN PATENT DOCUMENTS

| | | |
|---|---|---|
| 0 601 485 A2 | 6/1994 | European Pat. Off. . |
| 0 618 078 A2 | 10/1994 | European Pat. Off. . |
| 2-63-42432 | 8/1988 | Japan . |
| 2-64-10152 | 2/1989 | Japan . |
| 64-42667 | 2/1989 | Japan . |
| 1-152683 | 6/1989 | Japan . |
| 4-107888 | 4/1992 | Japan . |

OTHER PUBLICATIONS

Patent abstract of Japan, Publication No. 63005970 A, Jan. 11, 1988.

Patent Abstract of Japan, Publication No. 56156813 A, Dec. 3, 1981.

Patent Abstract of Japan, Publication No. 06118304 A, Apr. 28, 1994.

*Primary Examiner*—N. Le
*Assistant Examiner*—Thinh Nguyen
*Attorney, Agent, or Firm*—Oliff & Berridge, PLC

[57] ABSTRACT

An image recording apparatus has an array light source having a plurality of light-emitting elements arrayed in a predetermined density; a photosensitive member exposed to light beams emitted from the plural light-emitting elements so that images are recorded by fixing a traveling path of the light beams from the plural light-emitting elements to the photosensitive member and by moving the photosensitive member relative to the array light source; a beam-converging unit which intercrosses a bundle of the light beams emitted from the light-emitting elements onto a beam-conversion point; and an focusing unit disposed between the beam-converging unit and the photosensitive member, which images the light beams emitted from the plural of light-emitting elements and intercrossed by the beam-converging unit onto the photosensitive member.

14 Claims, 5 Drawing Sheets

IMAGE RECORDING APPARATUS WITH AN ARRAY LIGHT SOURCE

BACKGROUND OF THE INVENTION

1. Field of the Invention

The present invention relates to an image recording apparatus having an array light source, and particularly to an image recording apparatus which can realize high-quality and high-density image recording at a high speed.

2. Description of the Related Art

In a conventional image recording apparatus, for example, laser light modulated in accordance with an image signal is emitted from a laser light source, scanned in a main scanning direction by a polygon mirror, and a photosensitive drum rotating in a sub-scanning direction is exposed to the laser light scanned by the polygon mirror, so that an electrostatic latent image is formed on the photosensitive drum by this scanning exposure, and image recording is realized on the basis of this electrostatic latent image.

However, according to such a light deflection type image recording apparatus using a polygon mirror, there is a limit in making the recording speed high because there is also a limit in making the rotation velocity of the polygon mirror high.

Therefore, in order to make the recording speed of an image recording apparatus high, there has been considered an image recording apparatus which does not use a polygon mirror but use an array light source which is driven in accordance with the pattern of an image to be recorded and emitting a plurality of light beams.

A conventional image recording apparatus which does not use a polygon mirror is, for example, disclosed in Japanese Patent Unexamined Publication No. Sho-64-42667. This image recording apparatus has a structure in which a surface light-emitting laser array is disposed near a photosensitive drum to perform exposure of the photosensitive drum directly. According to this image recording apparatus, it is considered that high-speed image recording can be performed by driving the surface light-emitting laser array at a high velocity, and driving the photosensitive drum at a rotation velocity corresponding to the driving velocity of the surface light-emitting laser array.

According to the conventional image recording apparatus, however, the surface light-emitting laser array is disposed to directly face the photosensitive drum, and the degree of focusing of laser light of the surface light-emitting laser array is not sufficient. Accordingly, it is impossible to perform high-density image recording with high quality, such as 1,200 dpi required recently. On the other hand, even if a rod lens array is disposed between the surface light-emitting laser array and the photosensitive drum to increase the degree of focusing, the lens diameter of any lens element becomes smaller as the density of picture elements becomes higher. As a result, the recording density can not be increased because of reduction in MTF (Modulation Transfer Function). At the same time, the focal depth becomes so small that it is difficult to accurately attach the array light source having a fear to produce more or less warp, to the photosensitive member, and it is therefore difficult to perform focusing with the surface light-emitting laser array as a whole.

SUMMARY OF THE INVENTION

It is an object of the present invention to provide an image recording apparatus which can realize high-quality and high-density image recording at a high speed.

An image recording apparatus has an array light source having a plurality of light-emitting elements arrayed in a predetermined density; a photosensitive member exposed by light beams emitted from said plural light-emitting elements so that images are recorded by fixing the traveling path of said light beams from said plural light-emitting elements to said photosensitive member and by moving relatively the positions of said photosensitive member exposed by said light beams; a beam-converging unit which converges a bundle of said light beams emitted from said light-emitting elements onto a beam-conversion point; and a focusing unit disposed between said beam-converging means and said photosensitive member, which images said light beams emitted from said plural of light-emitting elements and converged by said beam-converging means onto said photosensitive member.

In an image recording apparatus according to the present invention, light beams emitted from an array light source arranged correspondingly to the density of pixels are converged at a beam-converging point, and imaged onto a photosensitive member by a focusing lens disposed at or near the beam-converging point. Accordingly, it is possible to use a focusing lens having a diameter sufficiently larger than the beam diameter of the light beams, and it is possible to make MTF and focal depth take values respectively corresponding to the density of pixels. As a result, it is possible to provide an image having high picture quality and high pixel density by high speed recording. In addition, when the light quantity of the light beams is detected on the basis of light beams at or near the beam-converging point, it is possible to improve the detection accuracy of the light quantity of the light beams so that it is possible to provide an image having superior picture quality and high pixel density by high speed recording.

PREFERRED EMBODIMENTS OF THE INVENTION

Figure 1A:
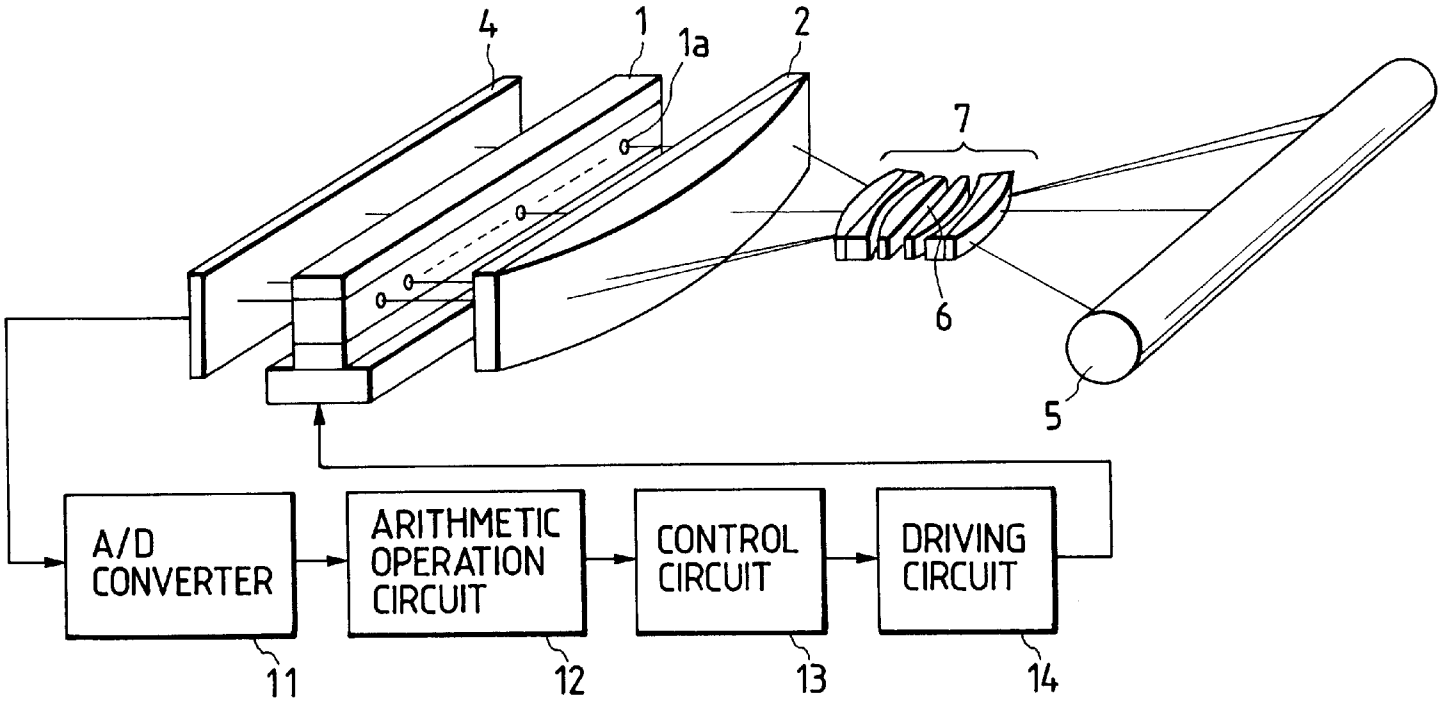
FIGS. 1A and 1B are explanatory diagrams illustrating an image recording apparatus of a first embodiment according to the present invention.
Figure 1B:
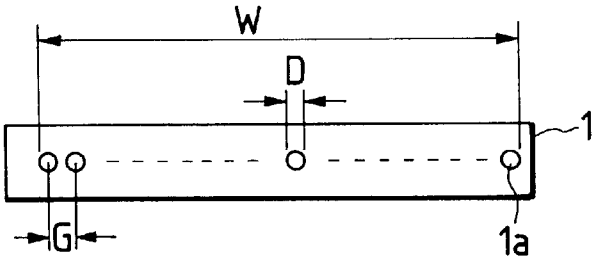

FIGS. 1A and 1B show an image recording apparatus of a first embodiment according to the invention according to the present invention. In the image recording apparatus, a laser array 1 has a plurality of laser light-emitting elements 1*a* arranged in an array, a field lens 2 converges a plurality of laser beams emitted from the respective laser light-emitting elements 1*a* onto a beam-converging point 6, an orthometer-type lens group 7 images the laser beams emitted from the respective laser light-emitting elements 1*a* onto respective focusing points, the exposure area of a photosensitive drum 5 is positioned at the respective focusing points of the plural laser beams, a light detection element 4 such as a photodiode receives back-outgoing light of the laser array 1 and outputs a detection signal, an A/D converter performs an A/D converting of the detection signal of the light detection element 4, an arithmetic operation circuit 12 receives the digital-converted detection signal form the A/D converter 11, stores this detection signal in a RAM, compares it with a reference value, and outputs the comparison result to a control circuit 13, and a driving circuit 14 receives a control signal from the control circuit 13 and drives the laser array 1.

The laser array 1 has 1,400 laser light-emitting elements 1*a* arranged in a line, and each of the laser light-emitting elements 1*a* has an aperture diameter D of 5 $\mu$m and has a distance G of 21 $\mu$m between it and an adjacent one of laser light-emitting element 1*a*, as shown in FIG. 1B. Therefore, the width W of the laser array 1 including the opposite-end laser light-emitting elements 1*a* becomes about 294 mm.

In such a configuration, when the respective laser light-emitting elements 1*a* of the laser array 1 are driven by the driving circuit 14 in accordance with an image signal, the laser beams emitted from the respective laser light-emitting elements 1*a* are converged to the beam-converging point 6 by the field lens 2, and imaged onto the photosensitive drum 5 by the orthometer-type lens group 7. The photosensitive drum 5 rotates at a predetermined velocity in the sub-scanning direction, and an electrostatic latent image in accordance with the image signal is formed on the surface of the photosensitive drum 5.

Based on the above-mentioned configuration and operation, image recording of 1,200 dpi can be performed at a high speed.

On the other hand, in a test mode, the respective laser light-emitting elements 1*a* of the laser array 1 are driven individually by the driving circuit 14. The light detection element 4 sequentially receives back-outgoing light of the respective laser light-emitting elements 1*a* , and outputs detection signals to the A/D converting circuit 11. The A/D converting circuit 11 converts the detection signals from analog values into digital values, and outputs these digital values to the arithmetic operation circuit 12. Then the arithmetic operation circuit 12 stores these digital values in a RAM, and thereafter reads them from the RAM to compare them with their reference values respectively. When the comparison result is outputted from the arithmetic operation circuit 12 to the control circuit 13; if the detection signal is larger than the reference value, the control circuit 13 generates a control signal for reducing a driving current for each of the laser light-emitting elements 1*a* in accordance with the difference, and if the detection signal is smaller than the reference value, the control circuit 13 generates a control signal for increasing the driving current in accordance with the difference. The driving circuit 14 stores the control signal in a RAM for every laser light-emitting element 1*a*, and reads the control signal at the time of driving so as to drive each of the laser light-emitting elements 1*a*.

In the mode of the first embodiment, respective laser beams are converged into the beam-converging point 6 by the field lens 2, and imaged onto the photosensitive drum 5 by the orthometer-type lens group 7 having a symmetrical shape with respect to the beam-converging point 6. Since the orthometer-type lens group 7 is disposed at the beam-converging point 6, the aperture of the orthometer-type lens group 7 can be made large enough relative to the spot diameter of each of the laser beams. As a result, MFT cannot be reduced, so that it is possible to perform high-density image recording.

Figure 2:
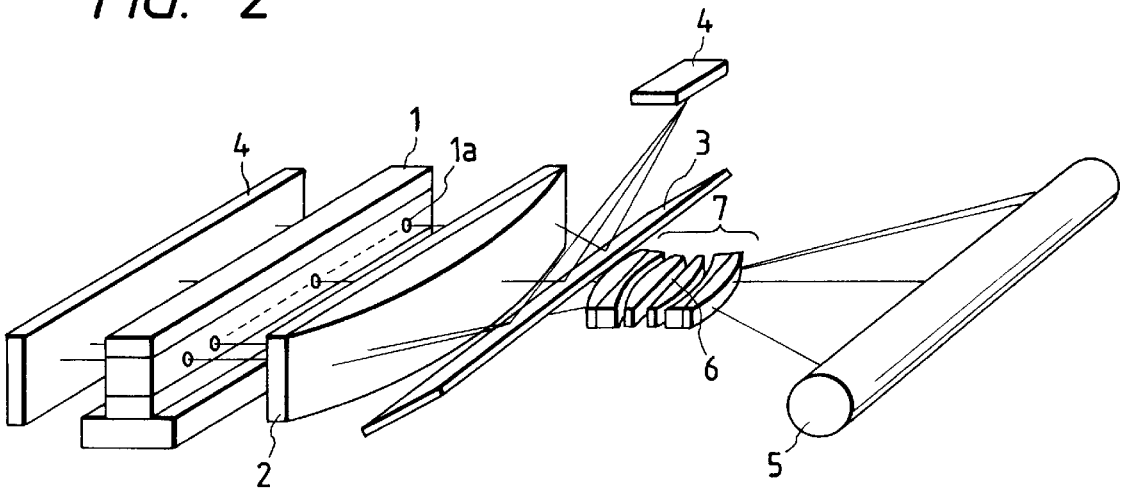
FIG. 2 is an explanatory diagram illustrating an image recording apparatus of a second embodiment according to the present invention.

FIG. 2 shows an image forming apparatus of a second embodiment according to the present invention, in which the light detection element 4 does not detect back-outgoing light of the laser array 1 but receives reflected light of a half-mirror 3 disposed between the field lens 2 and the orthometer-type lens group 7. It is therefore possible to reduce the light reception area of the light detection element 4. The operation is the same as that of the first embodiment, and therefore its description is omitted.

The importance of the light detection element 4 in an image recording apparatus using an array light source according to the present invention will be described.

A light deflection type recording apparatus using a polygon mirror is disclosed in Japanese Patent Examined Publication No. Sho-64-10152, or Japanese Patent Examined Publication No. Sho-63-42432. In this apparatus, as a method for adjusting the light emission quantity of a plurality of light beams, a plurality of back-outgoing beams of a laser light source are detected by one light reception element so as to perform correction of the light quantity. At this time, the back-outgoing beams are directly detected by the common light reception element disposed on the back side, or the back-outgoing beams are made incident into the light reception element by means of a lens or optical fibers. Although these light detection means are effective if the number of light-emitting elements is several, there are many problems as will be described below when a number of light-emitting elements are provided, for example, correspondingly to the number of pixels in the direction of recording width like in the present invention.

For example, as the density becomes high, it is impossible in practice to provide an optical fiber in each of the light-emitting elements. In addition, also in the case where light-emitting elements each having a large area are formed, there is scattering in film thickness in a film forming process, so that there is a fear that the photoelectric conversion properties vary in accordance with the light reception position of a light reception element actually receiving beams emitted from the respective light-emitting elements. In addition, in the case where light beams are converged by lenses, a lens only for detection of the light quantity occupies a considerably large volume of the apparatus if a light source is extremely long like an array light source.

In addition, the light beams detected by these light-emitting elements are back-outgoing beams unlike the light beams which are actually used to perform exposure of a photosensitive member. Therefore, such a method cannot be used in a light source which does not generate back-outgoing light. Even if back-outgoing light can be detected, fore-outgoing light is not always emitted in the same quantity as the back-outgoing light, so that it is necessary to confirm the ratio of the light quantity of the back-outgoing light to the fore-outgoing light. In addition, in case where the generation of the fore-outgoing light is stopped because of a failure in laser formation or the like so that only the back-outgoing light is emitted even if white coming-out is produced in an image, clearing-up of the reason is delayed because the apparatus operates normally apparently. On the contrary, when only the fore-outgoing light is emitted, there is a fear that a malfunction is caused to supply an excessive current to increase the quantity of emitted light because the light quantity of the back-outgoing light is not detected. In the case of a light deflection type in which about one or two laser beams are deflected and scanned by a polygon mirror or the like, generally, fore-outgoing light radiated onto a photosensitive member is detected as an SOS (Start of Scan) signal directly by an SOS sensor disposed adjacently to the photosensitive member so that the SOS signal is used for timing control of main scanning. Accordingly, non-lighting of the fore-outgoing light can be detected by the SOS sensor, but in the case of using an array light source, it is difficult to employ such a manner because the number of members corresponding to the polygon mirror or the number of laser elements to be examined is very large.

For the above reasons, an image recording apparatus using an array light source is hardly used for forming high-density images. Such an apparatus is shipped from a factory after only adjusting the quantity of emitted light in advance. No means for adjusting the quantity of emitted light is provided in the apparatus, and the apparatus is merely used for recording with low density and low image quality at an extent that scattering of light-emitting elements causes no trouble.

Therefore, in the second embodiment according to the invention, the half mirror 3 is disposed near the beam-converging point 6, and reflected light therefrom is detected by the light detection element 4, so that the light reception area of the light detection element 4 can be reduced. Therefore, detecting the quantity of light emitted from a number of laser light-emitting elements can be attained accurately while enlargement of the shape suppressed. To prevent the influence of scattering of photoelectric conversion due to the position of light reception, or to suppress the enlargement of size of the apparatus, it is more effective to dispose the half mirror and the light detection element in positions so that light flux of laser array having passed the beam-converging optics is converged onto the light detection element.

Figure 3:
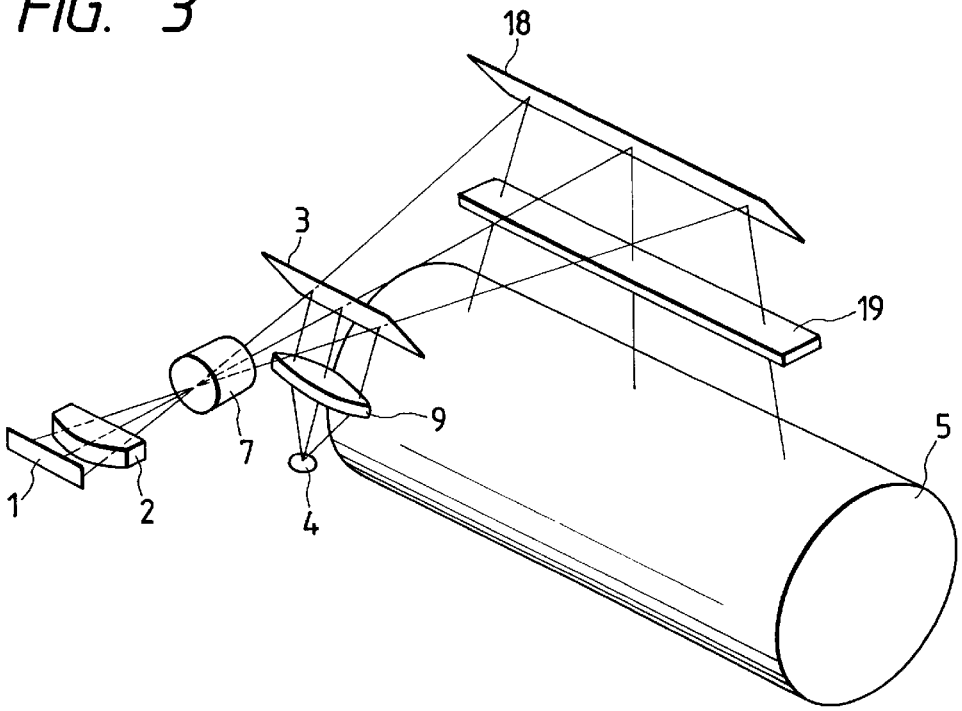
FIG. 3 is an explanatory diagram illustrating an image recording apparatus of a third embodiment according to the present invention.

FIG. 3 shows an image recording apparatus of a third embodiment according to the present invention, and parts the same as those in the first and second embodiments are referenced correspondingly, so that description of those parts is omitted. In this embodiment, light transmitted through an focusing lens 7 such as a xenotar-type lens or a double Gauss-type lens is projected onto a photosensitive member 5 through a half mirror 3, a mirror 18, and a window glass 19. The light beams from respective emitting points of a semiconductor laser array 1 which are reflected by a half mirror 3 are converged again by a beam-converging lens 9, and are incident to a light reception element 4. With such a configuration, it is possible to attain effects similar to those of the second mode.

Figure 4:
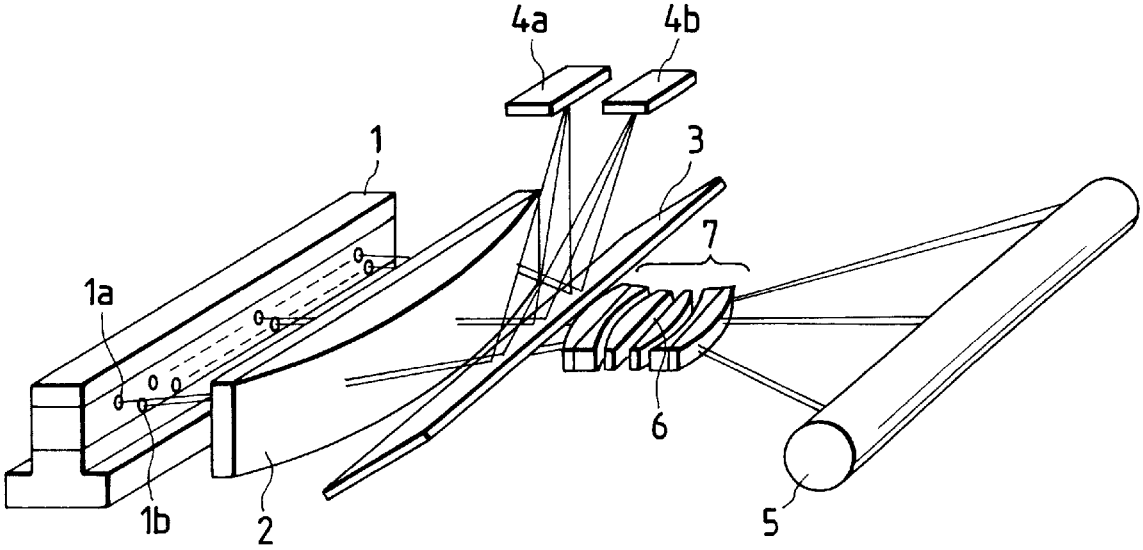
FIG. 4 is an explanatory diagram illustrating an image recording apparatus of a fourth embodiment according to the present invention.

FIG. 4 shows an image recording apparatus of a fourth embodiment according to the present invention, and parts which are the same as those in the first to third embodiments are referenced correspondingly, so that the description about those parts is omitted. A laser array 1 has first linear laser light-emitting elements 1*a* and second linear laser light-emitting elements 1*b*. A first light detection element 4*a* is provided correspondingly to the respective laser light-emitting elements 1*a*, and a second light detection element 4*b* is provided correspondingly to the respective laser light-emitting elements 1*b*. Since the first and second light detection elements 4*a* and 4*b* are provided, it is possible to monitor the two lines of laser light-emitting elements 4*a* and 4*b* simultaneously, and it is also possible to monitor them independently. If monitoring is performed simultaneously, monitoring time can be reduced.

Although the light detection elements 4*a* and 4*b* are provided separately, they may be integrated with each other so as to be common to the two lines of laser light-emitting elements 1*a* and 1*b*. In addition, although each of the light detection elements 4*a* and 4*b* has only one light reception area in the above description, each of the light detection elements 4*a* and 4*b* may have a plurality of light reception areas.

Figure 5:
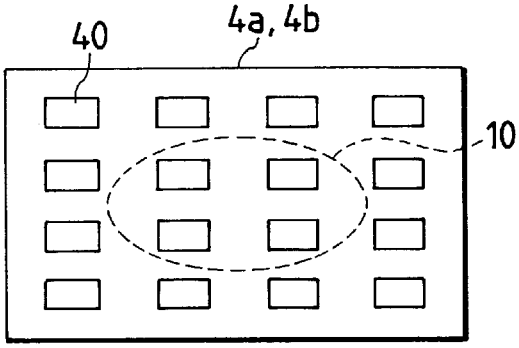
FIG. 5 is an explanatory diagram illustrating a modification of a light detection element which can be used in the first to fourth embodiments.

FIG. 5 shows the light detection element 4*a* or 4*b* having a plurality of light reception areas 40, in which an elliptic laser beam 10 is incident onto the light reception plane thereof. A driving current applied to the corresponding light-emitting element 1*a* or 1*b* is controlled on the basis of a detection signal obtained by summing the light reception quantity of the respective light reception areas 40.

Figure 6A:
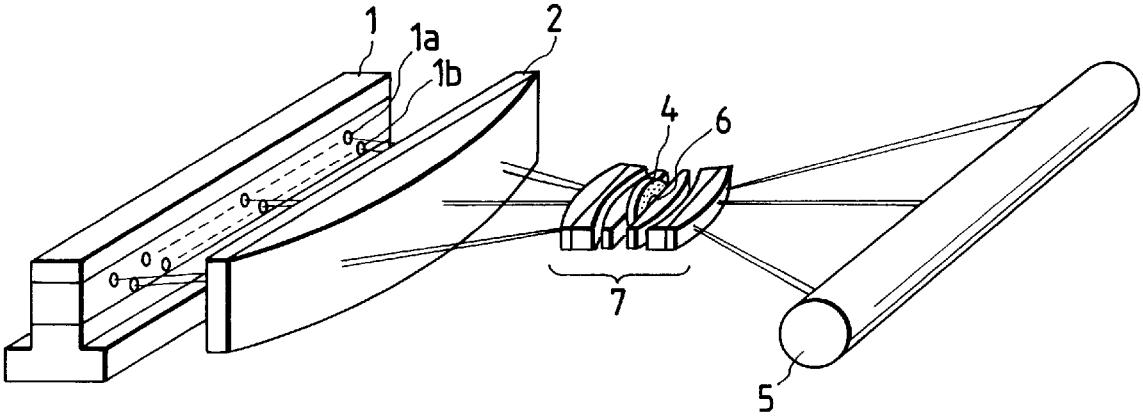
FIGS. 6A and 6B are explanatory diagrams illustrating an image recording apparatus of a fifth embodiment according to the present invention.
Figure 6B:
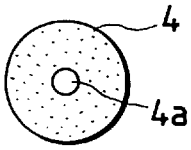

FIGS. 6A and 6B show an image recording apparatus of a fifth embodiment according to the present invention, and parts which are the same as those in the first to fourth modes are referenced correspondingly, so that the description about those parts is omitted. A light detection element 4 having an aperture 4*a* is disposed at a beam-converging point 6.

Laser light beams emitted from respective laser light-emitting elements 1*a* and 1*b* pass the aperture 4*a* of the light detection element 4. If the light quantity of the respective laser light beams changes, the light reception quantity of the light detection element 4 around the aperture 4*a* changes. Driving currents of the corresponding laser light-emitting elements 1*a* and 1*b* are controlled on the basis of the change of the light reception quantity.

Figure 7A:
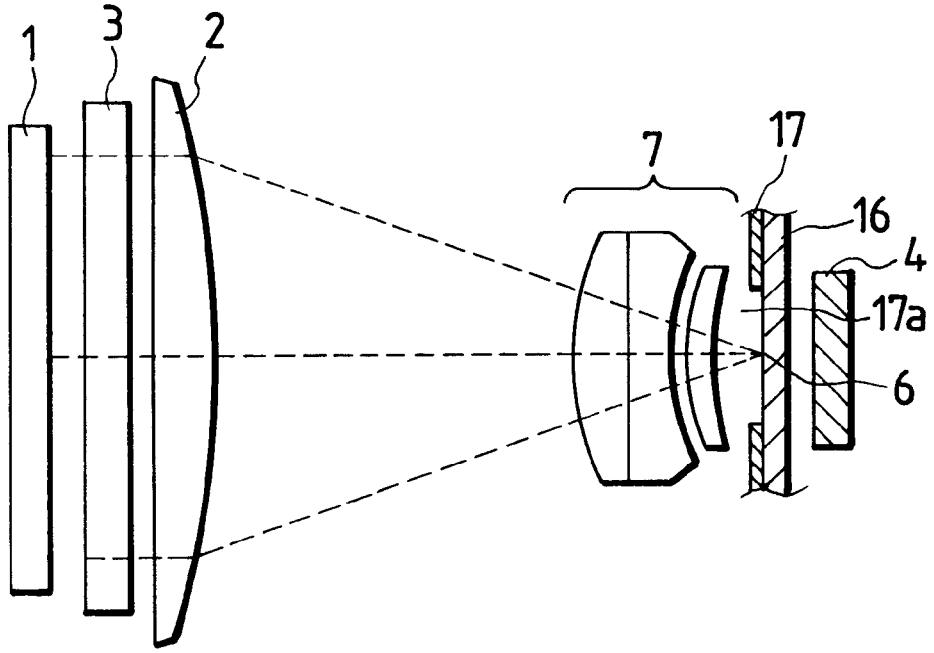
FIGS. 7A and 7B are explanatory diagrams illustrating an image recording apparatus of a sixth embodiment according to the present invention.
Figure 7B:
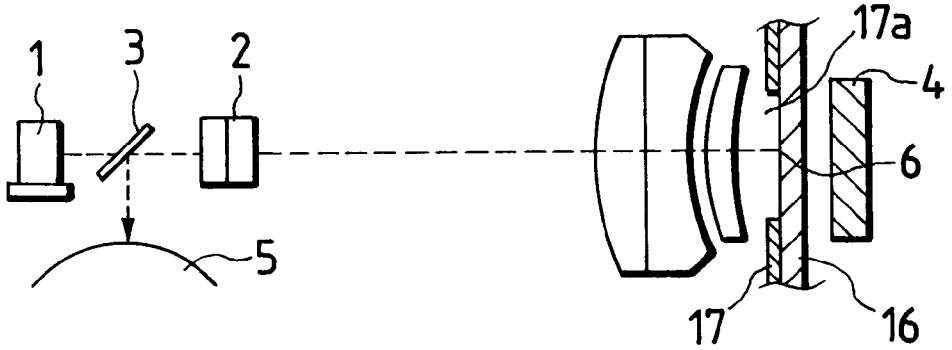

FIGS. 7A and 7B show an image recording apparatus of a sixth embodiment according to the present invention, and parts which are the same as those in the first to fifth embodiments are referenced correspondingly, so that the description about those parts is omitted. A light-transmissible mirror 16 having a reflectance of less than 100% and a predetermined transmissivity, and an aperture plate 17 having an aperture 17*a* are provided at a beam-converging point 6.

In the above-mentioned configuration, laser light emitted from laser light-emitting elements (not-shown) of a array 1 passes through a half mirror 3, and then are directed to the beam-converging point 6 by a field lens 2. The laser light directed to the beam-converging point 6 passes through the aperture 17*a* of the aperture plate 17, and then are mostly reflected on a mirror 16. The reflected light passes through the aperture 17*a* again, reaches the half mirror 3 again so as to be reflected thereon, and then are used for exposure of a photosensitive drum 5. A halved body of an orthometer-type lens group 7 which is made symmetrical centering the beam-converging point 6 by the mirror image effect of the mirror 16 is disposed on the optical axis of the laser light, so that the laser light is imaged on the photosensitive drum 5. On the other hand, a part of the laser light having permeated through the mirror 16 is received by a light reception element 4, and a driving current applied to the corresponding laser light-emitting elements is controlled in accordance with the light quantity, as described in the first to sixth modes.

In the sixth embodiment, the light path length is reduced to about a half by the arrangement of the mirror 16, so that it is possible to make the apparatus smaller in size.

Although a laser array is used as the array light source in the above-mentioned first to sixth embodiments, it may be replaced by light-emitting diodes, electroluminescent elements, fluophor light-emitting elements, or the like, arranged in array.

The respective light quantities of the arrays of light-emitting elements are monitored and their driving parameters are controlled so that a recorded image having uniform-density, high-quality and high-density recorded pixels can be obtained. It is a matter of course that such operation can be used for failure detection of the respective light-emitting elements of the array light source. In addition, when auxiliary light-emitting elements are provided in the array light source, it is possible to cope with a failure in some of the light-emitting elements by driving the auxiliary light-emitting elements. In this case, the position in the main scanning direction depends on the position of the auxiliary light-emitting elements, but the position of the sub-scanning direction can be defined by the driving timing of the auxiliary light-emitting elements. In addition, when a beam-converging lens is disposed on this side of the light detection element, the light reception area of the light detection element can be further reduced, so that it is possible to improve the detection accuracy.

What is claimed is:

1. An image recording apparatus without having a rod lens array, comprising:

an array light source having a plurality of light-emitting elements arrayed in a predetermined density;

a photosensitive member exposed to a light beam emitted from said plurality of light-emitting elements so that images are recorded by fixing said light beam from said plurality of light-emitting elements to said photosensitive member and by moving said photosensitive member relative to said light beam;

beam-converging means for including a bundle of said light beams emitted from said plurality of light-emitting elements within one aperture of said beam-converging means and intercrossing said bundle of light beams at or adjacent to a beam-conversion point; and focusing means, which is disposed between said beam-converging means and said photosensitive member, for focusing said light beams emitted from said plurality of light-emitting elements and intercrossed by said beam-converging means onto said photosensitive member wherein, without the rod lens array, said light beams travel unimpededly between the array light source and said beam-converging means.

2. An image recording apparatus according to claim 1, wherein said beam-converging means is a field lens.

3. An image recording apparatus according to claim 1, wherein said focusing means is selected from at least one of an orthometer-type lens group, a xenotar-type lens, and a double Gauss-type lens.

4. An image recording apparatus according to claim 1, further comprising reflecting means having an aperture, which is disposed near said beam-converging point, for reflecting said light beam from said beam-converging means, wherein said focusing means inputs both the bundle of light beams incident to the reflecting means and the bundle of light beams reflected from said reflecting means into the aperture.

5. An image recording apparatus according to claim 1, further comprising:

detection means for detecting light intensity of said light beams; and control means for controlling driving conditions of said light-emitting elements in accordance with a detection result of said detection means.

6. An image recording apparatus according to claim 5, further comprising:

light path changing means for changing the light path of said bundle of light beams into a direction different from the light path to said photosensitive member, said light path changing means being provided between said beam-converging means and said beam-converging point of said focusing means;

wherein said detection means is disposed in the travelling direction of said bundle of light beams the light path of which is changed by said light path changing means.

7. An image recording apparatus according to claim 6, wherein said light path changing means transmits a predetermined ratio of the light quantity of said incident bundle of light beams.

8. An image recording apparatus according to claim 6, wherein said light path changing means is a light-transmissible mirror.

9. An image recording apparatus according to claim 6, further comprising second beam-converging means for converging said bundle of light beams, said second beam-converging means being provided on the light path from said light path changing means to said detection means.

10. An image recording apparatus according to claim 6, wherein said detection means is a light reception element which is disposed at or near said beam-converging point and has an aperture portion formed at a light reception portion for transmitting said light beam.

11. An image recording apparatus according to claim 6, wherein said detection means is a light reception element having a light reception portion for photoelectric conversion output corresponding to the total light reception quantity received in an area larger than an irradiated region irradiated by said lightbeam from said plural light-emitting elements.

12. An image recording apparatus according to claim 6, wherein:

said detection means is a light reception element having a plurality of light reception portions smaller than an irradiation region irradiated by said light beam from said plural light-emitting elements; and said control means controls driving conditions of said plural light-emitting elements on the basis of output values of said plural light reception portions.

13. An image recording apparatus according to claim 6, wherein:

said light-emitting elements of said array light source are disposed two-dimensionally on a plurality of lines; and said light reception element receives the light quantity of the light-emitting elements belonging to a predetermined line of said plural lines.

14. An image recording apparatus according to claim 4, further comprising:

detection means for detecting light intensity of said light beam; and control means for controlling driving conditions of said plural light-emitting elements in accordance with the detection result of said detection means;

wherein said reflecting means is a light-transmissible mirror for transmitting a part of the incident light quantity; and said detection means is disposed so as to detect light transmitted through said light-transmissible mirror, of said light beam incident from said plural light-emitting elements.

* * * * *